United States Patent [19]

Gordon

[11] Patent Number: 4,474,222

[45] Date of Patent: Oct. 2, 1984

[54] STUD STARTER GUIDE PLATE

[76] Inventor: Lester Gordon, 2101 Sunset Point Rd., #202, Clearwater, Fla. 33515

[21] Appl. No.: 526,009

[22] Filed: Aug. 24, 1983

[51] Int. Cl.[3] ..... B25C 3/00

[52] U.S. Cl. ..... 145/1 B; 145/46

[58] Field of Search ..... 145/1 R, 1 B, 1 A, 46

[56] References Cited

U.S. PATENT DOCUMENTS 3,126,928 3/1964 McMillan ..... 145/1 B

FOREIGN PATENT DOCUMENTS 603316 8/1978 Switzerland ..... 145/46

*Primary Examiner*—Frederick R. Schmidt
*Assistant Examiner*—J. T. Zatarga
*Attorney, Agent, or Firm*—Ronald E. Smith

[57] ABSTRACT

A carpentry tool. The tool has a plurality of laterally spaced spike members that are driven into a sole plate or header to anchor the tool at a preselected location thereon where it is desired to position an upstanding stud of the type used in wall construction. A nail-guiding bore means is collectively defined by separate, axially aligned, bores formed in a horizontal flange that is hammered to seat such spikes and in a vertical plate that abuts the stud being installed. The tool is positioned transverse to the sole plate or header, its flange is hammered to seat the spikes, and nails are driven as required on the side of the stud opposite the tool, which tool prevents displacement of the stud during such nailing procedure. A nail is then introduced through the bore defined by the tool and seated to complete the installation, the tool being left in place to further enhance the quality of the construction.

5 Claims, 3 Drawing Figures

STUD STARTER GUIDE PLATE

BACKGROUND OF THE INVENTION

1. Field of the Invention.

This invention relates, generally, to carpentry tools, and more specifically relates to a tool that facilitates toe nailing of a stud to a sole plate or a header.

2. Description of the Prior Art.

A search of U.S. patents that was conducted prior to the filing of this disclosure located the following patents in the general field of this invention:

| Patentee | U.S. Pat. No. | Date of Issue |
|---|---|---|
| Rienecker | 2,575,595 | 11/20/51 |
| Kalina | 332,453 | 01/21/53 |
| Vargo | 2,957,507 | 10/25/60 |
| Bravo | 2,969,819 | 01/31/61 |
| McMillan | 3,126,928 | 03/31/64 |
| Vroman | 3,357,464 | 12/12/67 |

When the walls of a building are being erected, it is the usual practice to pour a concrete slab or other suitable foundation means to support the floors and walls of the building. Walls are typically constructed by laying sole plates (2"×4" boards) in a horizontal disposition at preselected locations on the slab, securing the same to the slab, by affixing studs (also 2"×4" boards) on, usually, 16" centers along the length of such sole plates, in upstanding relation thereto, and by capping the studs with headers, which are also 2"×4" boards. In effect, the upstanding studs are disposed in sandwiched relation to the sole plates and the headers. The difficult part of such construction lies in the nailing together of the boards where they join, i.e., where the respective lowermost ends of the studs abut the sole plates, and where the uppermost ends of the studs abut the headers. Carpenters typically place their foot on one side of a stud while driving a nail at a thirty degree angle to interconnect the stud and the sole plate, in an effort to prevent the stud from moving responsive to the hammer blows. Once a nail has been successfully seated on the side of the stud opposite the carpenter's foot, it then becomes a relatively simple matter to repeat the procedure on the other side of the stud to accomplish the desired interconnection of boards meeting at a right angle.

Unfortunately, this "toe nailing" procedure, as it is called in the trade, is less than optimal. It is virtually impossible to maintain the correct position of the stud during toe nailing, for example. Nor is it a simple matter to always drive the nails at the optimal thirty degree angle. Moreover, the interconnection of the stud and the hard to reach header is even more difficult, due to the inherent difficulty in driving nails at such locations.

A device is needed that will facilitate the toe nailing procedure and that will, accordingly, improve the final product of the craftsman's work. The needed device would not only speed up the construction process, but would even lower the level of skill required to erect a wall. The needed device does not appear in the prior art.

SUMMARY OF THE INVENTION

The longstanding but heretofore unfulfilled need for a tool that will facilitate wall construction by easing the task of nailing studs to sole plates and headers is now provided in the form of a stud starter guide plate. The device includes a generally rectangular plate member having coplanar spikes depending thereto. The spikes are positioned by the craftsman transversely to a sole plate or header where it is desired to position a stud, and a hammer is used to drive the spikes into such sole plate or header. To facilitate the hammering, the plate to which the spikes depend has a horizontally extending flange member that is supported by a specifically designed brace means so that hammering it does not deform it. The brace means also performs the very important function of transfering the force of the hammer blows from the flange member to the spikes. More specifically, the brace member's lowermost edge is spaced just upwardly of the spikes so that forces transmitted by said brace means impinge upon said spikes in the desired downward direction to seat the same.

A nail-receiving bore means is collectively formed, at the desired thirty degree angle, in the flange, the brace means and in the plate member so that when the plate member is positioned by the craftsman to abut an upstanding stud, with the spikes of the tool firmly embedded in the sole plate or header, nails are easily driven into the opposite side of such stud, it being understood that the embedded spikes prevent shifting movement of the stud responsive to the hammer blows delivered on the opposite side thereof.

It is therefore seen to be the primary object of this invention to provide a hand held tool that facilitates the mounting of studs in upstanding, sandwiched relation to sole plates and headers.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
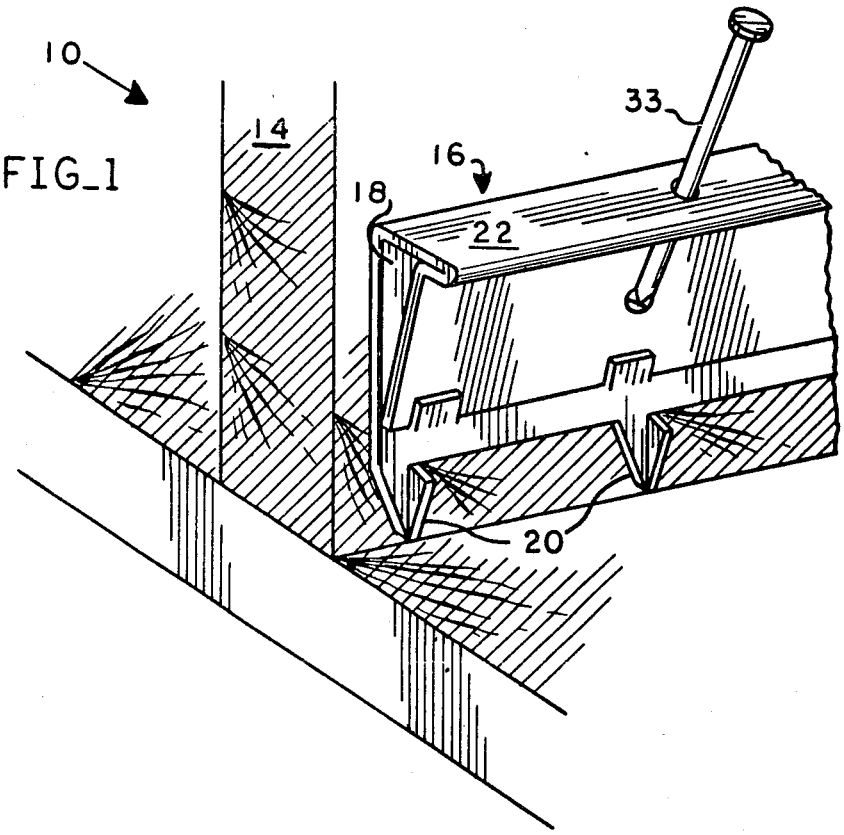
FIG. 1 is a perspective view showing the environment within which the invention is used.

Referring now to FIG. 1, it will there be seen that the environment in which the inventive tool is used is indicated by the reference numeral 10 as a whole.

The environment includes a horizontally disposed sole plate 12 which is usually a 2"×4" board, and a stud 14, which is a similar board. As stated hereinabove, studs 14 are normally spaced on 16" centers, in upstanding relation as depicted in FIG. 1, along the lengths of sole plates such as sole plate 12 and headers, not shown.

A first embodiment of the inventive tool is shown in FIG. 1 and designated 16 as a whole. The tool 16 includes a generally flat, rectangular in configuration plate member 18 that abuts stud 14 when in use, as is clear from FIG. 1. A plurality of spike members, collectively designated 20, depend to such plate member 18 and are disposed in a common vertical plane therewith and in equidistantly laterally spaced relation to one another. Each spike member 20 is a nail-like member having a body that tapers to a point as shown.

Figure 2:
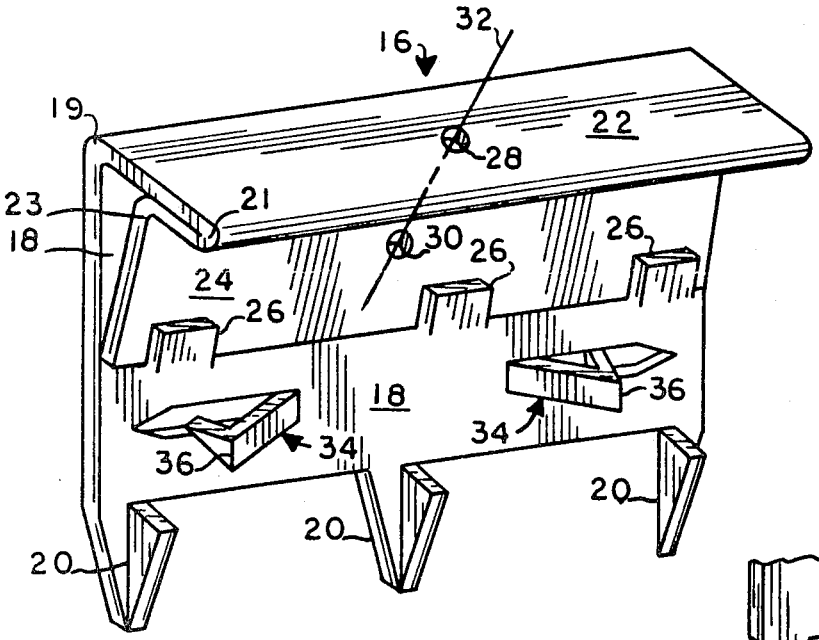
FIG. 2 is a perspective view of a preferred embodiment of the invention.

An alternative embodiment of the inventive tool 16 is shown in FIG. 2 and is shown in greater detail than the embodiment shown in FIG. 1. A flange or lip member 22 is shown disposed in a horizontal plane and extending from the upper longitudinal edge of plate member 18 in a direction away from a stud when such plate 18 is operatively positioned thereagainst as depicted in FIG. 1. The lip 22 is braced or supported by a brace member 24 that, in turn, is supported along its lowermost edge by a plurality of support members, collectively designated 26.

It should be observed that the plate member 18, the lip 22, and the brace 24 are of integral construction. Thus, said elements are formed simply by bending plate 18 firstly as at 19 (a slightly greater than 90 degree bend), secondly as at 21, (a 180 degree bend), and thirdly as at 23 (a 90 degree bend). It should also be observed that the support members 26 may easily be formed by stamping the same from plate member 18, as is clear from an inspection of FIG. 2. The support members 26 ensure that lip or flange 22 will not be displaced when hammer blows impinge thereagainst and also serve to ensure the transfer of downwardly directed forces from the flange 22 to the spikes 20 via brace 24, as mentioned hereinabove. Spot welds or other suitable means could be employed in lieu of the support members.

A first bore means 28 is formed in lip 22 as shown, and a second bore means 30 is formed in plate 18, substantially centrally thereof as shown (the bore also extends through brace 24). The longitudinal axis of symmetry of said bore means, indicated as 32 in FIG. 2, is disposed, preferably, a 30 degree angle from the vertical, since such angle is believed to be the optimal angle for driving a nail into a stud and sole plate or header.

Tab members 34 may also be stamped from plate 18, and bent as at 36 (a 90 degree bend) to provide additional means for securing the tool 16 to a stud 14. The stamping procedure provides the tabs 34 in a bent disposition extendingly rearwardly of plate 18, with the pointed distal free ends of such tabs 34 being positioned to engage a board when tab 34 is hammered.

A stud 14 is properly positioned, preferably, by first hammering lip 22 to drive spikes 20 into a sole plate 12 or header at the correct, predetermined position transversely of such sole plate or header. The stud is then positioned against plate 18 and nails are driven at the preferred angle into the stud from the side opposite the tool 16, as aforesaid. The embedded spikes 20, in conjunction with plate 18, will bar the stud against displacement during such nailing procedure. A nail is then inserted into bores 28 and 30, as shown in FIG. 1, and such nail 33 is driven home, or seated, to substantially complete the board joining procedure. When the embodiment of FIG. 2 is used, the procedure is completed in full by seating the spiked ends of tabs 34, as aforesaid.

The tool 16 need not be positioned on the sole plate or header prior to the positioning of the stud thereagainst as above described. Some craftsmen may prefer to position the stud first, for example, followed by use of the tool. The exact manner of use is a manner of convenience or preference with the individual craftsman or home owner using the invention.

Figure 3:
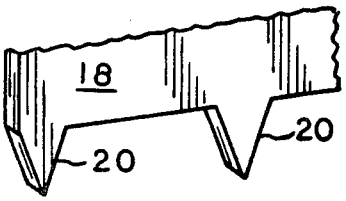
FIG. 3 is a fragmentary perspective view of an alternative embodiment.

An important feature of the tool 16 is the fact that it can be formed from a single plate of metal, by simply bending and stamping the same to produce either of the embodiments shown and described and obvious variations thereof which also lie within the scope of the claims appended hereto. Thus, the tool 16 can be mass produced inexpensively, since large quantities thereof will be used in a single building. A few design modifications can of course be made to the embodiments shown, as suggested by FIG. 3, for example. Moreover, those skilled in the art of high impact plastics will appreciate that the tool need not be of metallic construction, and those skilled in the art of materials generally will be cognizant of other possibilities as well.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A tool of the type designed to facilitate the nailing together of two boards disposed in orthogonal, abutting relation to one another, comprising, in combination, a flat plate member of generally rectangular configuration, adapted to lie flat against a preselected one of the boards to be joined, at least one spike member depending to said plate member and disposed coplanar therewith, a rigid flange member formed along an upper longitudinal edge of said plate member, and extending therefrom, in normal relation thereto, in a direction away from the board against which said plate is positioned, a first bore means formed in said plate member, said first bore means having a longitudinal axis of symmetry disposed at a predetermined angular relation to the vertical, a second bore means formed in said flange member, said second bore means having a longitudinal axis of symmetry disposed in axial alignment to the longitudinal axis of symmetry of said first bore means, said first and second bore means adapted to receive and guide a nail means while such nail means is being driven by a hammer means, whereby a stud may be nailed to a sole plate by aligning said tool transversely to said sole plate, by driving said spike member into the sole plate by hammering said flange member, by positioning the stud in abutting relation to the plate member, by toe nailing the stud opposite the tool, and by inserting a nail through said first and second bore means and seating said nail.

2. The tool of claim 1, wherein said first and second bore means are aligned at a 30 degree angular disposition from the vertical.

3. The tool of claim 2, wherein a plurality of spike members depend to said plate member, in laterally spaced relation to one another.

4. The tool of claim 3, further comprising means for reinforcing said flange member, said reinforcing means comprising, a brace means, a support means for said brace means, said support means integrally formed with said plate member, and said brace means integrally formed with said flange member.

5. The tool of claim 4, wherein said tool further comprises, at least one opening formed in said plate member, downwardly of said support means for said brace means, a tab means, having a sharp distal free end, formed by stamping said opening so that said tab means is integrally formed with said plate member at its proximal end, said tab means having a right angle bend formed substantially mid-length thereof so that said sharp distal free end projects toward a board, said tab means disposed rearwardly of the plane defined by said plate member so that hammering said tab means drives its sharp distal free end into a board abutting said plate means to further secure said tool to said board and said boards to one another.

* * * * *